US005358042A

United States Patent [19]

Stoltz

[11] Patent Number: 5,358,042

[45] Date of Patent: Oct. 25, 1994

[54] HIGH ANGLE AND HORIZONTAL WELLBORE CENTRALIZER AND METHOD OF USE

[75] Inventor: Ronald P. Stoltz, Littleton, Colo.

[73] Assignee: Marathon Oil Company, Findlay, Ohio

[21] Appl. No.: 4,320

[22] Filed: Apr. 7, 1993

[51] Int. Cl.[5] ..... F21B 17/10

[52] U.S. Cl. ..... 166/241.6

[58] Field of Search ..... 166/241.1, 241.3, 241.4, 166/241.5, 241.6

[56] References Cited

U.S. PATENT DOCUMENTS

| | | | |
|---|---|---|---|
| 467,494 | 1/1892 | Black | 166/241.3 |
| 712,487 | 11/1902 | Black | 166/241.3 |
| 712,901 | 11/1902 | Black | 166/241.4 |
| 1,699,087 | 1/1929 | Woodmansee et al. | 166/241.3 |
| 1,893,020 | 1/1933 | Cushing . | |
| 2,601,478 | 6/1952 | Weir | 166/241.3 |
| 4,747,452 | 5/1988 | Clark | 166/311 |
| 4,776,397 | 10/1988 | Akkerman | 166/241.5 |
| 4,811,792 | 3/1989 | Lembcke et al. | 166/241.1 |
| 4,913,230 | 4/1990 | Rivas et al. | 177/241.3 |
| 4,958,692 | 9/1990 | Anderson | 175/323 |
| 5,033,558 | 7/1991 | Russo et al. | 175/325 |

*Primary Examiner*—Ramon S. Britts
*Assistant Examiner*—Frank S. Tsay

[57] ABSTRACT

A method and apparatus for running in a tubing string through a high angle or horizontal wellbore without damage to equipment on the tubing string. Centralizers are mounted on the tubing string at spaced intervals on either side of the equipment. The centralizers include spherical rollers which contact the wellbore casing and which are mounted so as to have little or no radially inward movement.

4 Claims, 2 Drawing Sheets

HIGH ANGLE AND HORIZONTAL WELLBORE CENTRALIZER AND METHOD OF USE

FIELD OF THE INVENTION

This invention relates to completion activities conducted in high angle and horizontal wellbores. More particularly, it relates to a method and means for facilitating the movement of tubing strings through such wellbores and for protecting equipment carried by the tubing strings against damage.

BACKGROUND OF THE INVENTION

Due to developing technology, horizontal wells are now being used both as producing wells and injection wells in the petroleum industry. Although selective perforation and stimulation activities are now able to be carried out in cased horizontal wells as well as in vertical wells, difficulties have been encountered in moving tubing strings and related equipment through the high angle and horizontal sections of the wells. As they traverse these sections, the tubing string and the completion equipment carried by the tubing string tend to slide along the bottom of the wellbore. This causes the operators to have a loss of "feel" to the tubing and tools, which is detrimental to accurately moving and positioning the tools in the desired area. It can also result in damage to the tubing string or equipment, requiring the tubing string to be withdrawn and the damaged portions of the tubing and equipment replaced.

In addition, difficulties have been encountered in properly placing and preventing damage to equipment used in multiple zone completion activities in horizontal injection wells.

It would be highly desirable to be able to carry out completion activities in horizontal wells without encountering problems caused by the traversing of tubing strings through high angle and horizontal sections of the wellbores.

BRIEF SUMMARY OF THE INVENTION

In carrying out the invention, equipment used in completion activities in a cased high angle or horizontal wellbore is attached to a tubing string. The equipment extends radially outwardly from the tubing string a distance less than the distance from the tubing string to the wellbore casing so that there is clearance between the equipment and the casing. Centralizers are mounted on the tubing string at locations upstream and downstream of the equipment. In some instances this may result in centralizers being provided on either side of a single piece of equipment. In others, depending on the completion procedures being carried out, centralizers will be provided on either side of a group of separate pieces or units of equipment.

The centralizers include spherical rollers which extend radially outwardly from the tubing string a distance substantially equal to the distance from the tubing string to the wellbore casing. When the tubing string is run into a cased high angle or horizontal wellbore, the spherical rollers of the centralizers contact the casing, thereby permitting the tubing string to have both axial and rotational components of movement through the casing. This is especially beneficial in cases where certain equipment requires the tubing string to be rotated, as in the case of a packer that requires rotation of the tubing string in order to be set. This arrangement of centralizers and equipment also protects the equipment against damage resulting from contact between the equipment and the casing during both running in and withdrawal of the tubing string from the casing.

Each spherical roller of the centralizer is mounted for rotation in a spherically shaped recess in a support body secured to the tubing string. The rollers are mounted in such a manner that they have substantially no radial movement capability. This gives a positive standoff to the equipment or tools mounted on the tubing string, thereby preventing them from becoming damaged.

The above and other aspects and benefits of the invention will readily be apparent from the more detailed description of the preferred embodiment which follows.

DETAILED DESCRIPTION OF THE PREFERRED EMBODIMENT

Figure 1:
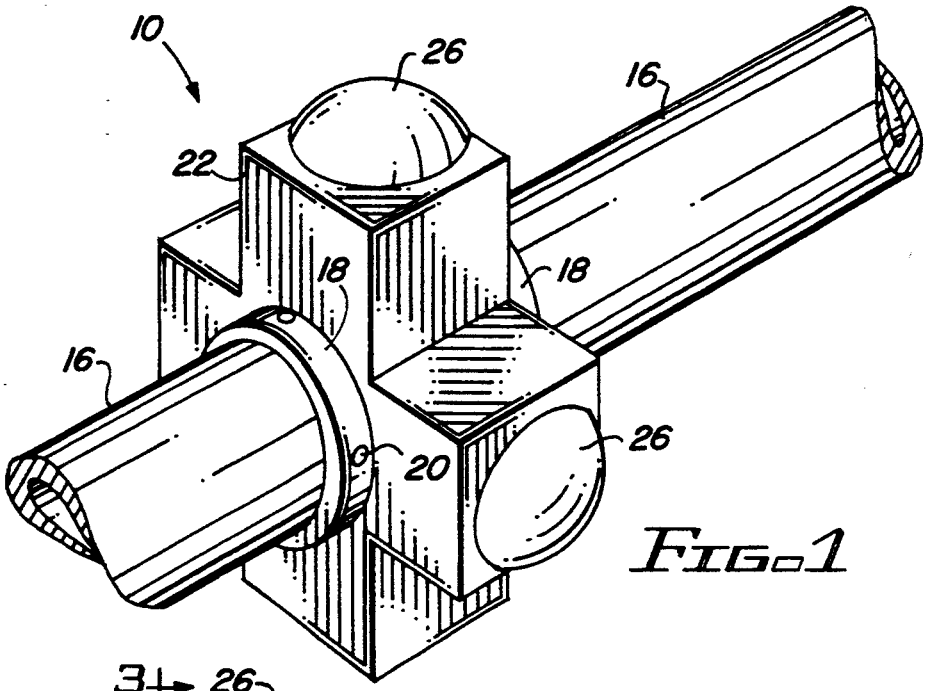
FIG. 1 is a pictorial view of the centralizer of the invention, shown mounted on a tubing string.
Figure 2:
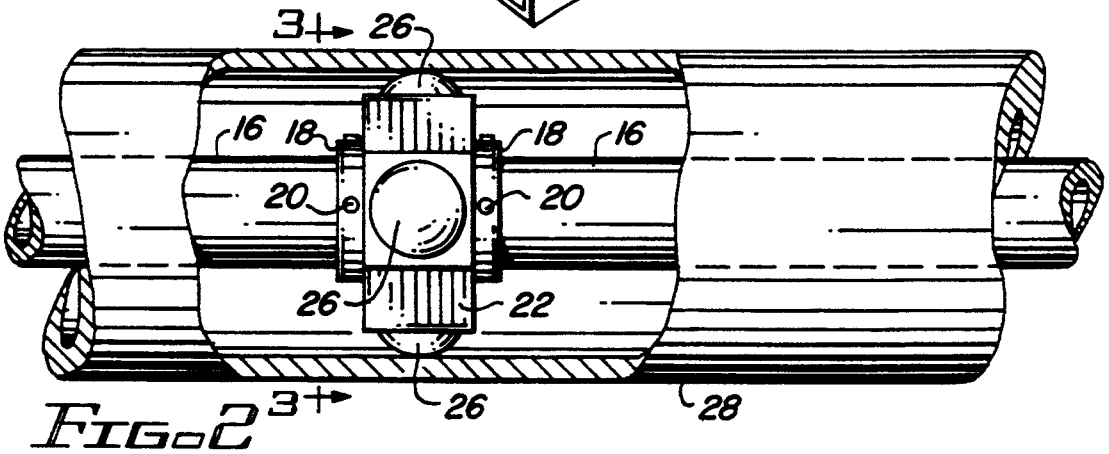
FIG. 2 is a side elevation of a horizontal cased wellbore partially broken away to reveal a tubing string having a centralizer mounted thereon.
Figure 3:
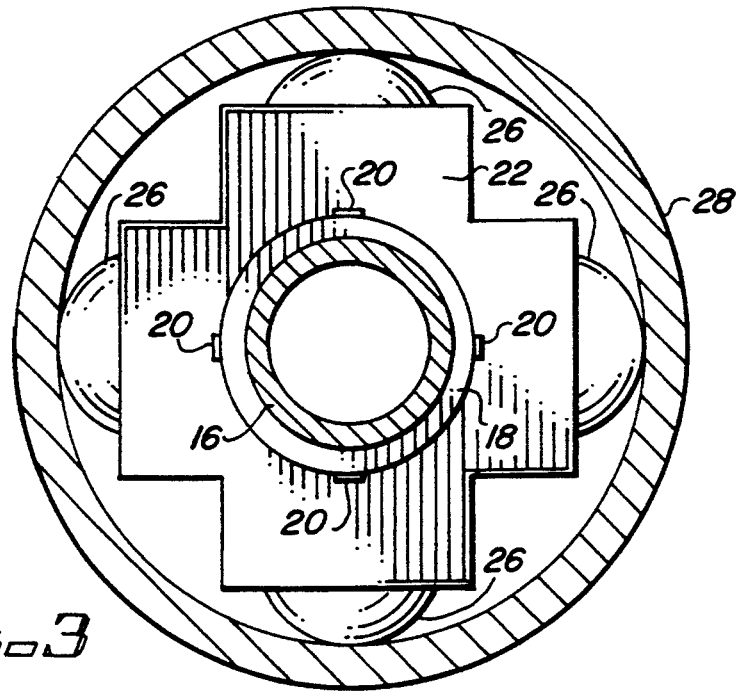
FIG. 3 is a transverse sectional view taken on line 3—3 of FIG. 2.

Referring to FIGS. 1, 2, 3 and 4, the centralizer 10 of the invention comprises a body 12 containing a centrally located bore 14 of a size to receive the tubing string 16. The centralizer may be mounted on the tubing string by sliding it onto a tubing string section and then anchoring it against sliding movement in either direction by means of stop rings 18 attached to the tubing string by lock screws 20. Other alternative ways of securing the centralizer body to a tubing string section can be used as desired, such as by providing screw threads on the bore 14 and threading the centralizer onto the end portion of a tubing string section.

The centralizer body is shown as having four outwardly extending support arms 22, each of which contains a bowl-shaped recess 24 for receiving a spherical roller element 26. The centralizer support arms 22 extend radially outwardly of the tubing string, terminating short of the wellbore casing 28. The recesses 24 and spherical rollers 26 are dimensioned to allow the rollers to extend radially outwardly to a point at which the rollers engage the inner surface of the casing.

Figure 4:
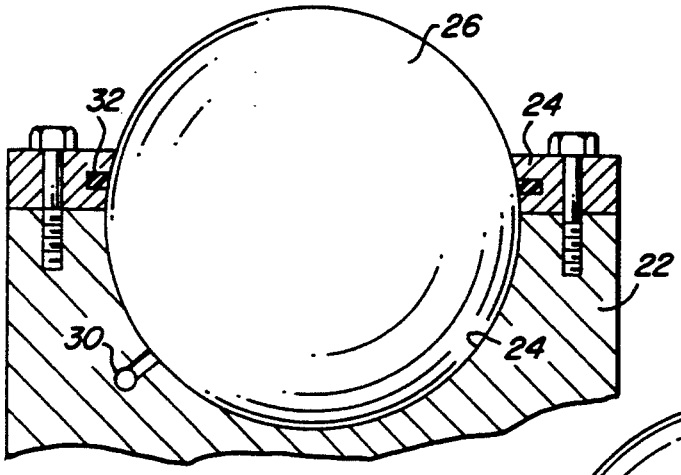
FIG. 4 is an enlarged partial transverse sectional view of a recessed portion of the centralizer body, showing a spherical roller mounted therein.

The spherical rollers may be mounted in any convenient manner which allows them to rotate in any direction. For example, as shown in FIG. 4 the roller is mounted in a bowl-shaped spherical recess 24 which has a radius of substantially the same length as the radius of the spherical roller 24. A retaining plate 29 attached to the outer surface of the support arm 22 has an inner surface which is contoured as a continuation of the recess 24 so as in effect to form part of the recess. The combined recess formed by the recess 24 and the inner surface of the retaining plate 29 receives a major portion of the spherical roller 26, thereby preventing the roller from escaping the recess.

The surface of the centralizer body forming the recess 24 in the arrangement shown in FIG. 4 is comprised of a polished bore, and the inner surface of the retaining plate 29 is also a polished surface. This reduces the friction between the recess and the roller, facilitating movement of the centralizer along the surface of a wellbore casing. Preferably, grease fittings 30 are provided to allow grease or other friction reducing material to be introduced into the recess. A continuous seal 32 is provided in the retaining plate 29 to prevent entry of foreign material into the recess.

Figure 5:
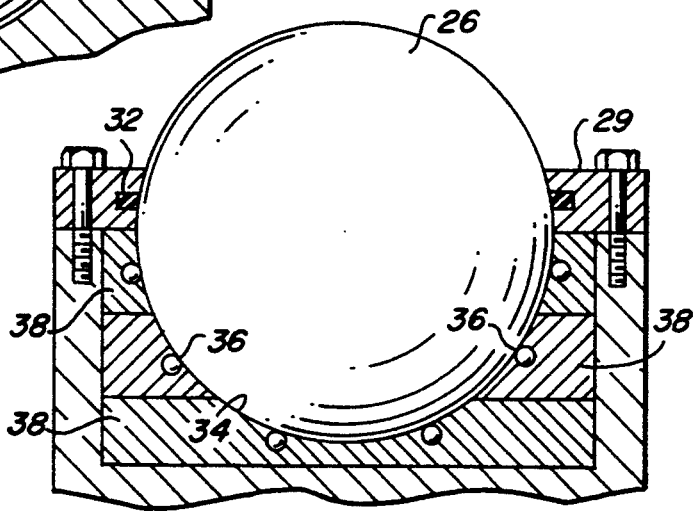
FIG. 5 is an enlarged partial transverse sectional view similar to that of FIG. 4, but showing a different mounting means for the spherical roller.

Another roller mounting arrangement is shown in FIG. 5, wherein the recess 34 is larger than the recess 24 of the FIG. 4 arrangement and wherein ball bearings 36 are provided in rings 38 that fit within the recess 34. The spherical rollers 26 are supported on the ball bearings 36, which further facilitates easy rotation of the rollers. A retaining plate 29 similar to the plate shown in FIG. 4 may also be provided.

It will be noted that in both roller mounting arrangements the spherical rollers are supported on unyielding surfaces. This is made possible by the fact that the rollers extend out from the tubing string substantially the same distance that the tubing string is spaced from the wellbore casing, thereby providing for the rollers to contact the casing. If it is desired to employ a centralizer on a tubing string to be run in a wellbore of a different diameter, centralizers having dimensions to fit that particular size wellbore would be employed. By mounting the rollers on unyielding surfaces, as opposed to being mounted in a yielding manner, such as, for example, on a spring biased surface, the centralizers prevent relative transverse or radial movement between a wellbore casing and the tools mounted on a tubing string, thereby preventing damage to the tools and enabling the tubing string to be moved smoothly through the casing.

Figure 6:
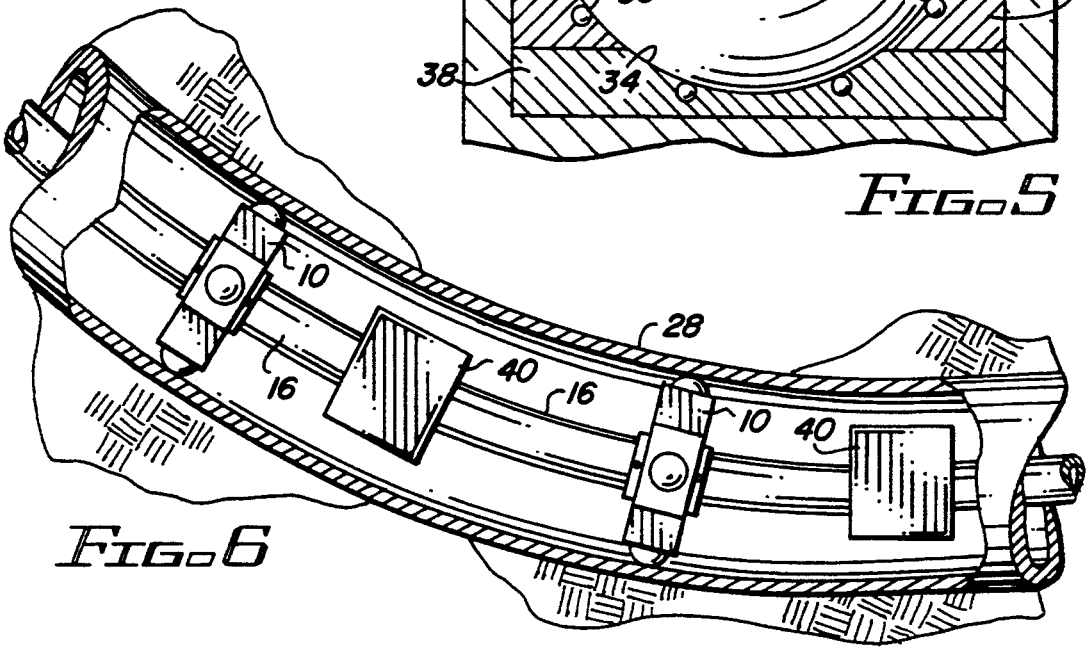
FIG. 6 is a longitudinal sectional view of a high angle section of a cased wellbore in which a tubing string, having centralizers mounted thereon, is positioned.

Referring now to FIG. 6, a tubing string 16 is shown in the process of traversing a high angle section of wellbore casing 28. For the purpose of illustration, tools or other equipment are shown mounted on the tubing string at spaced locations, with a centralizer 10 positioned both upstream and downstream of the equipment. It can be seen that the tools or equipment 40, which extend out from the tubing string a lesser distance than the centralizers, will not contact the wellbore casing at the critical curved transition areas between wellbore sections of different angles since the centralizers maintain the tubing string on a path which substantially coincides with the axis of the wellbore. Although only a single tool has been shown between centralizers, it will be understood that tools may be grouped together between centralizers as long as the centralizers are spaced close enough to each other to prevent the tools from contacting the casing at the curved portions of the wellbore.

Figure 7:
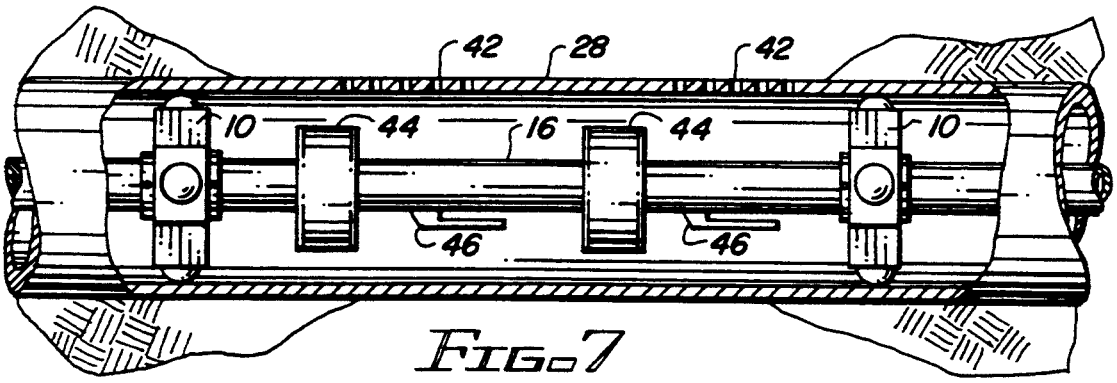
FIG. 7 is a longitudinal sectional view similar to that of FIG. 6, but showing a tubing string and centralizers positioned in a horizontal section of a cased wellbore.

A tubing string is shown in FIG. 7 in a horizontal section of wellbore casing 28 in connection with a multiple zone injection well completion process. In this process, to ensure injection into each interval, a multiple packer assembly and regulator set-up are utilized. For such an operation the casing is provided with perforations 42, and snap set packers 44 and side-pocket flow regulators 46 are mounted on the tubing string 16. Centralizers 10 are positioned on the tubing string downstream and upstream from the packers and flow regulators to prevent the tubing string from sagging down and causing the packers and flow regulators to slide along the casing. Not only is the tubing string moved through the wellbore casing more easily as a result, giving the operator more feel for the assembly as it traverses the horizontal section, but the tubing string is able to easily rotate upon demand in order to set the packers 44. While the packers and flow regulators are one example of units of equipment that are normally clustered together between centralizers, obviously other types of equipment may beneficially be grouped together between centralizers to benefit the operation.

The centralizer has been illustrated as having four spherical rollers which are equally spaced about the periphery of the centralizer body. This preferred arrangement provides support at opposite points on the casing to maintain the tubing string at the axis of the casing. It also provides a sufficient number of spherical rollers to enable easy movement through the casing as well as allowing the tubing string to have rotational movement as well. Thus, required rotational movements of the tubing string, such as those necessary for the setting of packers, as well as rotational components of generally axial tubing string movement caused by turns and curvatures in the casing, are greatly facilitated. As few as two equally spaced spherical rollers may be provided, as long as such an arrangement makes the desired facility of movement of the tubing string possible. Conversely, as many equally spaced rollers as may conveniently be mounted on a centralizer can be employed to provide the maximum amount of support and the maximum ease of movement of a tubing string through the wellbore casing.

It can now be appreciated that the present invention provides for a very economical means of facilitating completion operations in high angle and horizontal wells while at the same time preventing damage to equipment carried by a tubing string. The savings resulting from not having to replace damaged equipment and not having to repeat failed operations can be quite significant. The centralizer units themselves are simple in design and economical to fabricate, enabling different size centralizers to be kept on hand for use in various size wellbores.

It will now also be apparent that the invention is not necessarily limited to all the specific details described in connection with the preferred embodiment, but that changes to certain features of the preferred embodiment which do not alter the overall basic function and concept of the invention may be made without departing from the spirit and scope of the invention, as defined in the appended claims.

What is claimed is:

1. Apparatus for running in a tubing string for carrying out completion activities in a cased high angle or horizontal wellbore of predetermined diameter, comprising:

a tubing string having a known diameter for use in the wellbore;

equipment mounted on the tubing string and extending outwardly therefrom a distance less than the difference between the radii of the tubing string and the wellbore casing;

centralizers mounted on the tubing string at locations upstream and downstream of the equipment; and the centralizers including spherical rollers which are mounted on unyielding surfaces and extend outwardly from the tubing string a distance substantially equal to the difference between the radii of the tubing string and the wellbore casing;

the spherical rollers permitting the tubing string to have both axial and rotational components of movement when being moved through the casing and preventing the equipment mounted on the tubing string from contacting the casing during travel therethrough.

2. Apparatus for running in a tubing string according to claim 1, wherein each centralizer comprises a support body mounted on the tubing string, the support body having a plurality of regularly spaced recesses in the periphery thereof, each recess having a spherical roller mounted for rotation therein so as to be substantially incapable of radially inward movement.

3. Apparatus for running in a tubing string according to claim 2, wherein the centralizer support body includes at least four regularly spaced recesses.

4. Apparatus for running in a tubing string according to claim 2, wherein each recess comprises a polished spherically contoured bore for receiving a major portion of the spherical roller, the bore including friction reducing material therein in contact with the roller.

* * * * *